United States Patent [19]

Schmidt

[11] Patent Number: 5,000,373

[45] Date of Patent: Mar. 19, 1991

[54] MAILER WITH OVERSIZED INSERT AND METHOD OF MAKING

[75] Inventor: Eric Schmidt, Elgin, Ill.

[73] Assignee: Wallace Computer Services, Inc., Hillside, Ill.

[21] Appl. No.: 440,356

[22] Filed: Nov. 22, 1989

Related U.S. Application Data

[63] Continuation-in-part of Ser. No. 244,727, Sep. 15, 1988, Pat. No. 4,931,035.

[51] Int. Cl.[5] ..... B65D 27/10; B65D 27/34

[52] U.S. Cl. ..... 229/69

[58] Field of Search ..... 282/25; 53/206; 229/69

[56] References Cited

U.S. PATENT DOCUMENTS

| | | | |
|---|---|---|---|
| 3,337,120 | 8/1967 | Steidinger | 229/69 |
| 4,081,127 | 3/1978 | Steidinger | 229/69 |
| 4,343,129 | 8/1982 | Gunther, Jr. et al. | 53/206 |
| 4,380,315 | 4/1983 | Steidinger | 229/69 |
| 4,709,850 | 12/1987 | Wagner | 229/69 |
| 4,776,510 | 10/1988 | Jenkins | 229/69 |

*Primary Examiner*—Stephen P. Garbe

*Attorney, Agent, or Firm*—Tilton, Fallon, Lungmus & Chestnut

[57] ABSTRACT

A mailer having an oversized insert and method wherein an interior ply is both longitudinally and transversely folded and adhered to an unfolded interior ply.

5 Claims, 4 Drawing Sheets

FIG. 1
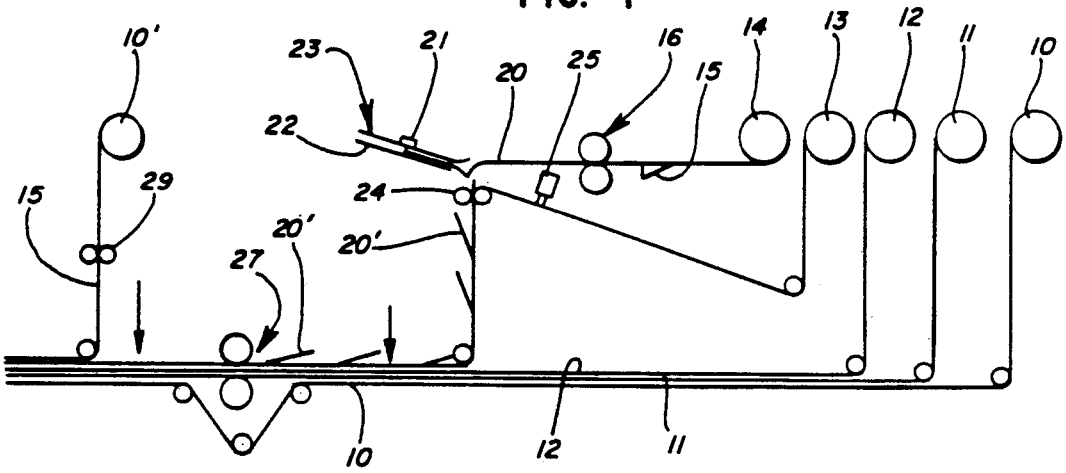
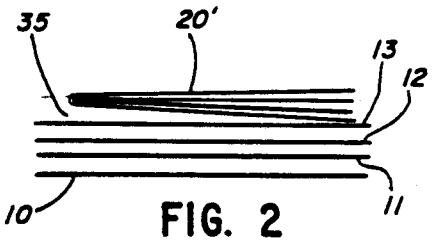
FIG. 2
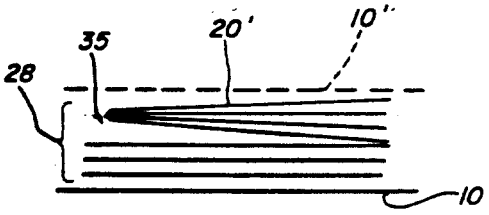
FIG. 3
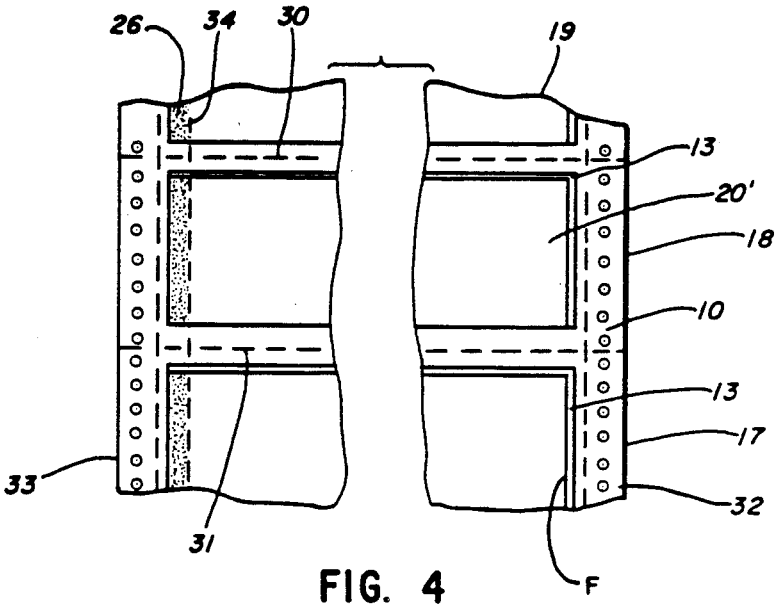
FIG. 4

FIG. 8
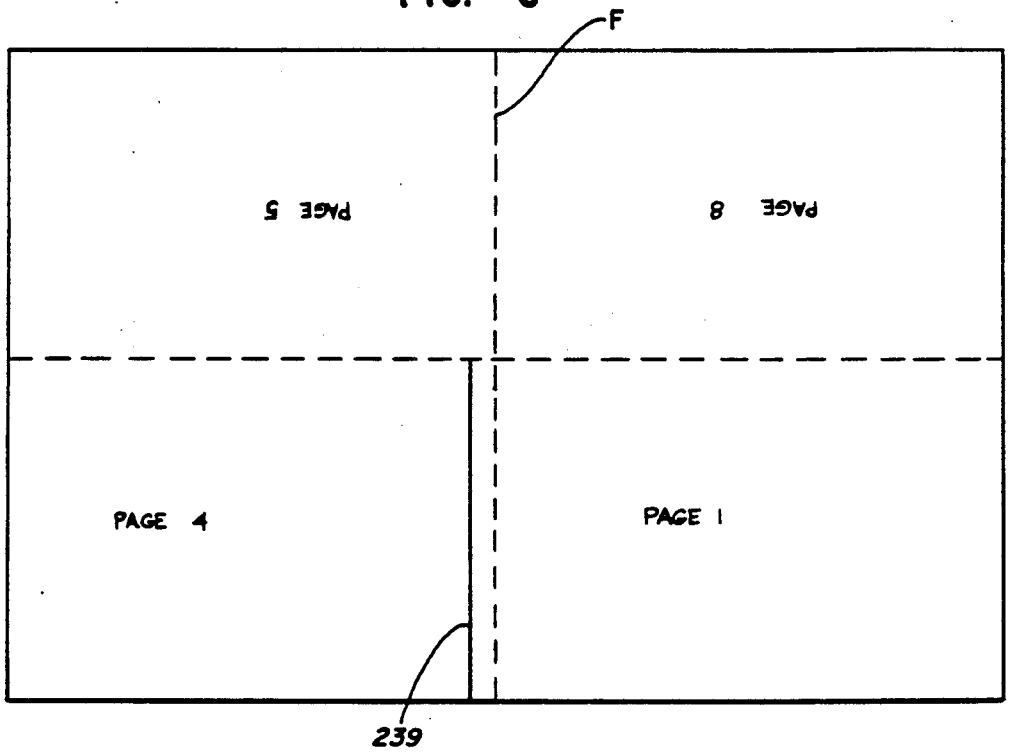
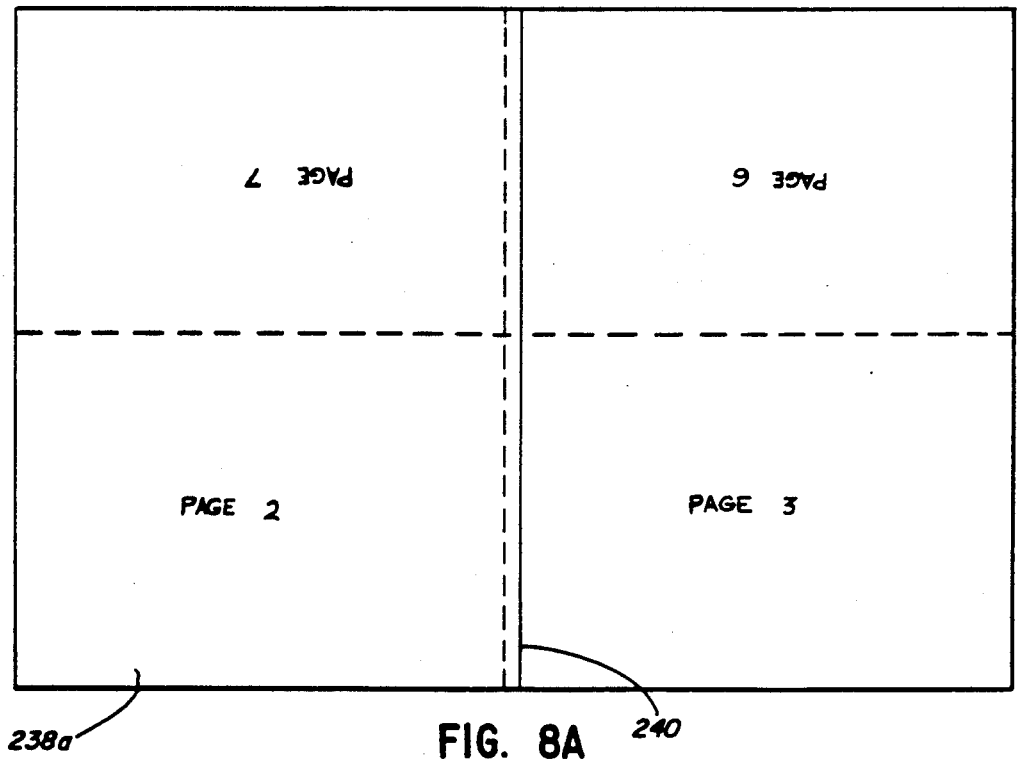
FIG. 8A

MAILER WITH OVERSIZED INSERT AND METHOD OF MAKING

This application is a continuation-in-part of my co-pending application Ser. No. 244,727 filed Sept. 15, 1988 now U.S. Pat. No. 4,931.035.

BACKGROUND AND SUMMARY OF INVENTION

This invention relates to a mailer having an oversized insert and method of making the same and, more particularly, to a connected series of stuffed, sealed envelope assemblies.

Heretofore, manufacturers of business forms have provided mailers with oversized return envelopes. However, no one had provided a transversely folded, oversized insert ply. Typically, however, the insert plies are smaller than the outer dimensions of the envelope —— as is the return envelope. A typical return envelope for a mailer is seen in co-owned Patent 4,081,127.

The inventive mailer is made by first longitudinally and then transversely folding a discrete ply and thereafter adhering it to a continuous web ultimately constituting the adjacent insert ply. This adjacent insert ply is transversely severed and thereafter adhesively secured to one of the outer plies of the envelope. Lines of longitudinally extending perforation are provided adjacent the glued edge of the insert plies which provides a removable stub so as to open the envelope while freeing the insert plies so that the same can be removed by the recipient. By selective slitting of the twice folded ply, a variety of advantageous constructions are made available.

The invention is described in conjunction with the accompanying drawing in which:

FIG. 1 is a schematic elevational view of apparatus employed in the practice of the invention;

FIG. 2 is a schematic side elevational view of a portion of the webs in FIG. 1 as seen at the position designated 2;

FIG. 3 is a view similar to FIG. 2 but showing the condition of the webs at position 3 of FIG. 1;

FIG. 4 is a top plan view of the webs as they would appear in position 3 of FIG. 1 or, alternatively, from the top of FIG. 3;

Figure 7:
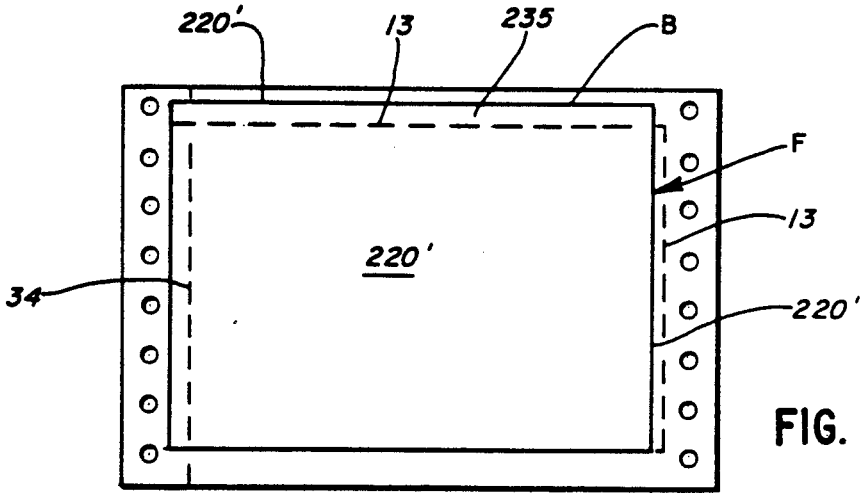

FIG. 7; is yet another schematic plan view of a further modification of the invention;

FIGS. 8 and 8A are plan views of a booklet insert for the mailer derived from the construction of FIG. 7; and FIGS. and 9 and 9A are schematic perspective views of yet another form of booklet available as an insert through the practice of the invention.

DETAILED DESCRIPTION

In the illustration given, the numerals 10–14 and 10' designate a series of parent rolls which are disposed along the length of the machine frame (not shown). The parent roll 10 provides a web or ply which ultimately becomes the bottom ply of the mailer, i.e., the stuffed envelope assembly —— see FIGS. 2–4. The parent rolls 11–13 provide insert plies as designated in FIG. 2 while the parent roll 14 provides a folded or oversized ply, similarly designated in FIG. 2. Lastly, the parent roll 10' provides the top or other exterior ply of the envelope assembly and is seen in dashed line at the top of FIG. 3.

In the practice of the invention, the web from the parent roll 14 is unwound and first longitudinally folded on itself by plow 15. It is then transversely severed by knife and anvil rolls generally designated 16. Here, it will be appreciated that the term "transverse" refers to the across machine direction whereas "longitudinal" refers to the direction in which the webs travel in the machine. This is to avoid any confusion because the envelope assemblies as seen in FIG. 4 as at 17, 18 and 19 have their longer dimensions extending transversely of the machine. Therefore, when the terms "transverse" and "longitudinal" are used herein, they refer to the web in the machine and not the individual envelope assemblies.

The longitudinally-folded severed segment from the web roll 14 is seen in the central upper portion of FIG. 1 and is designated 20. It is seen in the process of being transversely folded by having its forward or leading edge butted against a stop 21 of the chute 22 of the buckle folder generally designated 23. Such equipment is conventional. Thereafter, the now transversely-folded portion of the segment 20 enters between nip rolls 24 at which time it is adhesively united to the continuous web being unwound from the parent roll 13. This is indicated in FIG. 1 by the numeral 20'. Advantageously, prior to uniting the twice-folded web segment 20 with the web from the parent roll 13, the latter is equipped with a longitudinally extending line of adhesive by means of the applicator 25. The adhesive is depicted schematically in FIG. 4 as at 26 and is along the longitudinal edge of the twice-folded insert 20' opposite the plow-folded edge F —— see the lower right portion of FIG. 4. This plow-folded edge F is spaced inwardly of the adjacent longitudinal edge of the normal-sized insert ply 13.

The now folded insert plies 20' are seen attached to the web 13 and are joined with the webs 12 and 11 issuing from the similarly designated parent rolls. These three webs with the web 13 being equipped with the twice folded segments 20' enter another cutoff roll arrangement generally designated 27 which removes a chip from all of these webs. The condition of the webs prior to entering the cutoff means 27 is seen in FIG. 2 while thereafter, the condition is seen in FIG. 3. After the chips have been removed from the webs 11, 12 and 13, the assembly designated 28 in FIG. 3 is applied to the bottom web 10 which has been detoured around the cutting means 27.

Finally, the web 10' ultimately constituting the top web of the envelope assembly is superposed on the other five plies or webs. Incident to that, a pattern of adhesive is advantageously applied to the web 10' by the adhesive unit 29. This provides a perimeter of glue around and outside of the insert plies but which secures the top and bottom plies 10, 10' together in conventional fashion. The rectangular pattern of adhesive has been omitted from the showing in FIG. 4 for ease of understanding.

Normally, downstream of the superposition of the top ply 10' on the underlying plies, the continuous web assemblies are transversely perforated as at 30, 31 to define adjacent envelope assemblies. Conventionally, these are zig-zag folded and fed incrementally into a computer printer where the variable information is applied thereto. The operation of the manufacturing machinery and also the computer printer are facilitated by the usual control punch margins 32, 33.

A line of perforation in the final assembly at 34 is provided adjacent one longitudinal edge of the insert plies so as to provide a stub removable so as to open the envelope. This line of perforation may be provided most advantageously at the press —— the operation preceding the development of the parent rolls 10–14 and 10'. Normally, the webs are processed through printing presses to put down the format of the mailer into which the variable information is introduced. However, it is also possible to provide the longitudinally extending line of perforation 34 downstream of the superposition of the top ply 10'. Removal of one edge of the envelope assembly 18, for example, not only opens the envelope but also removes the stub which has secured the folded oversized ply 14 to the adjacent ply 13.

SUMMARY OF OPERATION

At the upper center, FIG. 1 shows an insert web to be twice folded which is derived from the parent roll 14. This is longitudinally folded at 15 and then transversely cut off by the cutoff means 16 consisting of knife and anvil rolls. This develops a segment 20 which is then transported to the buckle folder 23 until it reaches the stop 21. The segment 20 then buckles which may be along a line of weakening or perforation, and the twice folded segment 20' is directed through the nip rolls 24 where it is joined with the web 13.

Prior to the segment 20' being joined thereto, the web 13 has had a line of adhesive 26 applied by the glue nozzle 25. This line of adhesive holds the cut sheet insert 20' in position as the assembly proceeds through the subsequent chipping and collating operations. The result of the chipping operation can be seen in FIG. 3 where an overlap 35 is developed between the normal-sized insert plies and the twice folded segment 20'.

Figure 5:
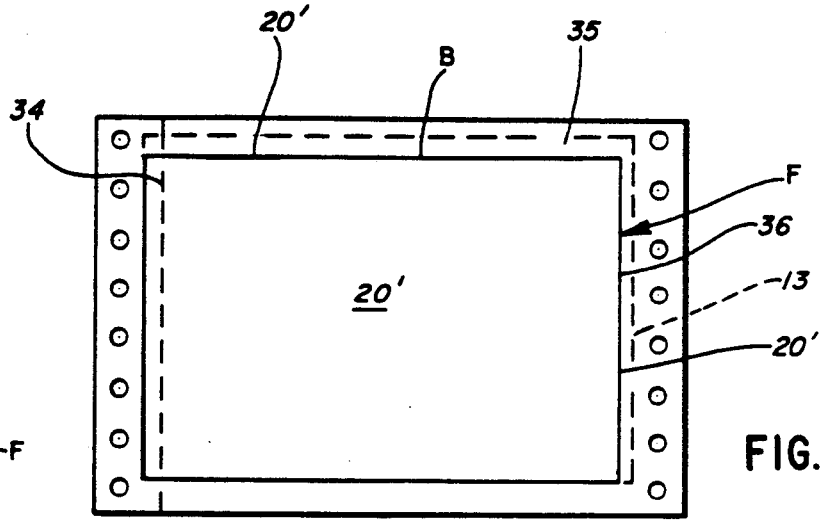
FIG. 5 is a plan view essentially schematic of the arrangement of the insert plies of FIG. 4
Figure 5A:
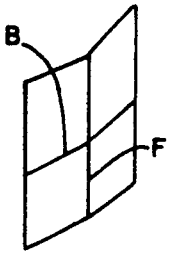
FIG. 5A is a perspective of the opened insert ply.

As indicated previously a variety of alternative folded insert plies are available from the practice of the invention. These can be appreciated by reference first to FIG. 5 which is essentially a simplified, schematic representation of one of the partial assemblies of FIG. 4. A normal sized ply is designated 13 and is seen in dashed line to provide an overlap 35 adjacent one transverse edge of the twice-folded ply 20' (seen in solid line)and another overlap as at 36 between one longitudinal edge of a normal sized insert ply 13 and the plow folded edge F. As indicated previously, the operation contemplates removing the tear strip along the longitudinally extending line of perforation 34 which releases the interior plies, including the twice folded insert ply 20'. This results in the four panel arrangment of FIG. 5A resulting from the plow fold F and buckle fold B.

Figure 6:
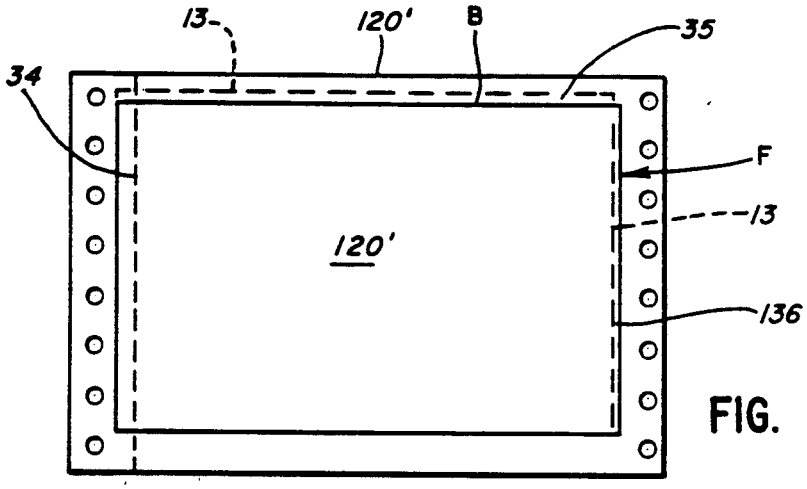
FIG. 6 is a view similar to FIG. 5 but of a modified arrangement of interior plies and FIG. 6A is a perspective of the trimmed opened insert ply.
Figure 6A:
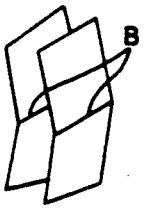

A first modification is seen in FIG. 6 where again the normal-sized insert ply is designated 13 and the overlap thereof relative to the twice folded ply 120' is again designated by the numeral 35. In this case, however, the plow folded edge F is initially outboard of the adjacent edge of the normal sized ply 13 so as to develop a reverse overlap as at 136. Prior to enveloping the interior plies between the bottom and top plies 10, 10', the overlap portion 136 is slit away resulting in two panel to panel sheets, each approximately one-half the size of the twice folded ply of FIG. 5. This would approximate two sheets of a normal $8\frac{1}{2} \times 11''$ size letter as seen in FIG. 6A.

The alternative in FIG. 7 is a construction which results from trimming the buckle folded edge B of the twice folded insert ply. The insert ply in FIG. 7 is designated by the numeral 220' and is seen to have a reverse overlap as at 235 between the adjacent transverse edge of the normal sized insert ply 13 and the plow folded edge B which is shown in solid line. This makes possible an 8-page booklet as can be appreciated from the showings in FIGS. 8 and 8A. In FIG. 8 one of the four panels developed by the double folding is designated 238 and corresponds to page 1 of the booklet. FIG. 8A represents the reverse side of the showing in FIG. 8 —— as if the showing in FIG. 8 were rotated 180° about a longitudinally extending edge. Thus, the reverse of page 1 is at the lower left in FIG. 8A and is designated **238*a*. By applying glue lines at as 239 and 240, and by trimming the overlap as at 235**, an 8-page booklet is developed —— with the various pages being bound along the plow folded edge F.

If the glue lines 239 and 240 are omitted and the overlap 235 is trimmed, two two-panel sheets result in interfolded relation.

Figure 9:
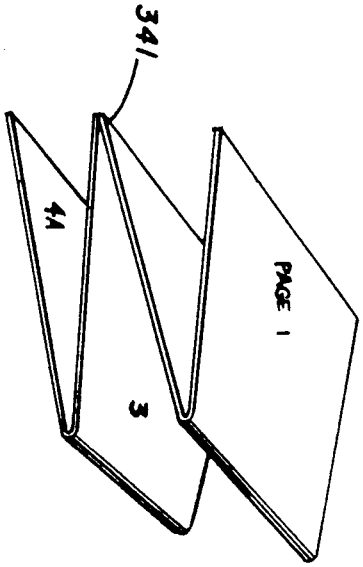
Figure 9A:
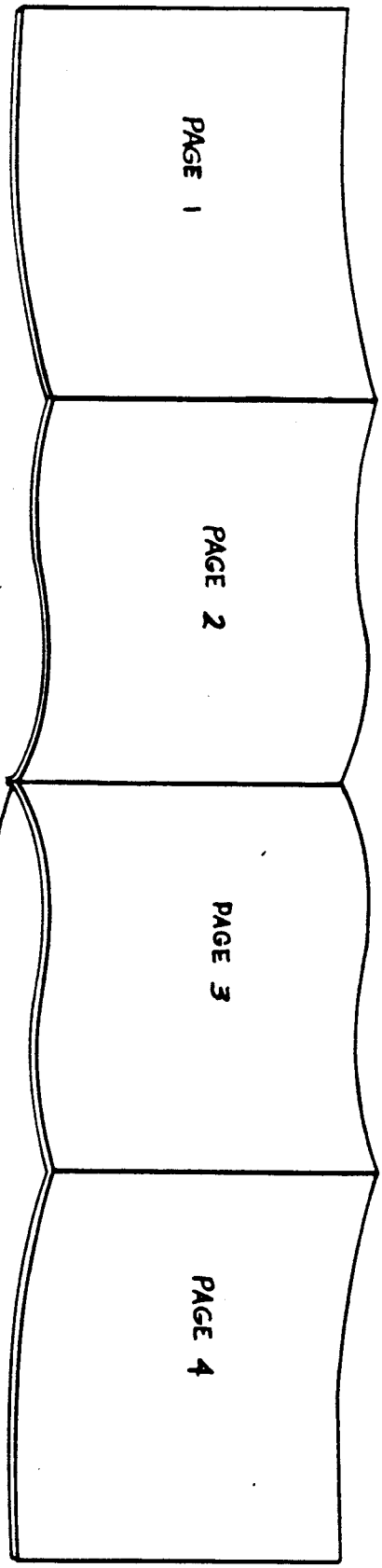

Then, if the two two-panel sheets are united along a longitudinally extending edge as at 341 in FIG. 9, an 8-page fold-out brochure results of the character seen in FIG. 9A. It will therefore be appreciated that by merely introducing a second fold, viz., the plow fold F, a significant variety of constructions are made available.

While in the foregoing specification a detailed description of an embodiment of the invention has been set down for the purpose of illustration, many variations may be made in the details given without departing from the spirit and scope of the invention.

I claim:

1. A series of connected mailers comprising exterior plies constituting an envelope front and back each equipped with at least one superposed longitudinally extending control punch margin adjacent one longitudinal edge, a plurality of equally spaced lines of transverse perforation defining a series of envelopes each having the front and back plies connected along all four sides thereof, a plurality of insert plies within each envelope, at least one of said plies being transversely folded on itself, said folded ply being adhesively secured to the adjacent ply along only one longitudinal line, said longitudinal adhesive line being immediately adjacent said one control punch margin and inward thereof, and a longitudinally extending line of perforation in all of said plies inward or said longitudinal adhesive line to provide a detachable tub for separating said folded ply from said adjacent ply.

2. The structure of claim 1 in which said folded ply is overlapped adjacent the folded transverse edge thereof by said adjacent ply.

3. A series of connected mailers comprising exterior plies constituting an envelope front and back, a plurality of equally spaced lines of transverse perforation defining a series of envelopes each having the front and back plies connected along all four sides thereof, a plurality of insert plies within each envelope at least one of said plies being transversely folded on itself, said folded ply being both longitudinally and transversely folded.

4. A series of connected mailers comprising exterior plies constituting an envelope front and back each equipped with at least one superposed longitudinally extending control punch margin adjacent one longitudinal edge, a plurality of equally spaced lines of transverse perforation defining a series of envelopes each having the front and back plies connected along all four sides thereof, a plurality of insert plies within each envelope at least one of said plies being longitudinally folded on itself, said folded ply being adhesively secured to the adjacent ply along only one longitudinal line, said longitudinal adhesive line being immediately adjacent said one control punch margin and inward thereof, and a longitudinally extending line of perforation in all of said plies inward of said longitudinal adhesive line to provide a detachable stub for separating said folded ply from said adjacent ply, the fold in said folded ply being positioned adjacent the other of said longitudinal edges.

5. The structure of claim 4 in which said envelope includes two longitudinally folded plies, one within the other.

* * * * *